United States Patent [19]

Kii et al.

[11] 4,239,949

[45] Dec. 16, 1980

[54] SELF-EXTINGUISHING TYPE CIRCUIT INTERRUPTER

[75] Inventors: Masami Kii; Yoshihiro Ueda; Koji Ibuki, all of Amagasaki, Japan

[73] Assignee: Mitsubishi Denki Kabushiki Kaisha, Tokyo, Japan

[21] Appl. No.: 889,548

[22] Filed: Mar. 23, 1978

[30] Foreign Application Priority Data

Mar. 24, 1977 [JP] Japan ..... 52/32917
Mar. 24, 1977 [JP] Japan ..... 52/32918

[51] Int. Cl.[3] ..... H01H 33/74
[52] U.S. Cl. ..... 200/148 R; 200/148 B; 200/148 C
[58] Field of Search ..... 200/148 R, 148 A, 148 B, 200/148 C, 148 D, 148 E, 148 F, 148 G, 148 H, 148 J, 148 BV

[56] References Cited

U.S. PATENT DOCUMENTS 3,524,958 8/1970 Frink ..... 200/148 A
4,032,736 6/1977 Ruffieux et al. ..... 200/147 R

*Primary Examiner*—J. V. Truhe
*Assistant Examiner*—Morris Ginsburg
*Attorney, Agent, or Firm*—Robert E. Burns; Emmanuel J. Lobato; Bruce L. Adams

[57] ABSTRACT

A self-extinguishing circuit interrupter wherein a pair of separable contacts is disposed within an arc extinguishing gas. Energy of an electric arc established between the separated contacts is utilized to increase the pressure of the arc extinguishing gas, and the high pressure gas thus generated is introduced into a pressure chamber to be stored therein. When the arc current approaches zero, the high pressure gas within the pressure chamber is puffed to the arc to extinguish it. A plurality of pressure chambers are axially disposed, i.e., in the direction in which the movable contact moves, thereby improving the arc extinguishing capability of the circuit interrupter.

5 Claims, 2 Drawing Figures

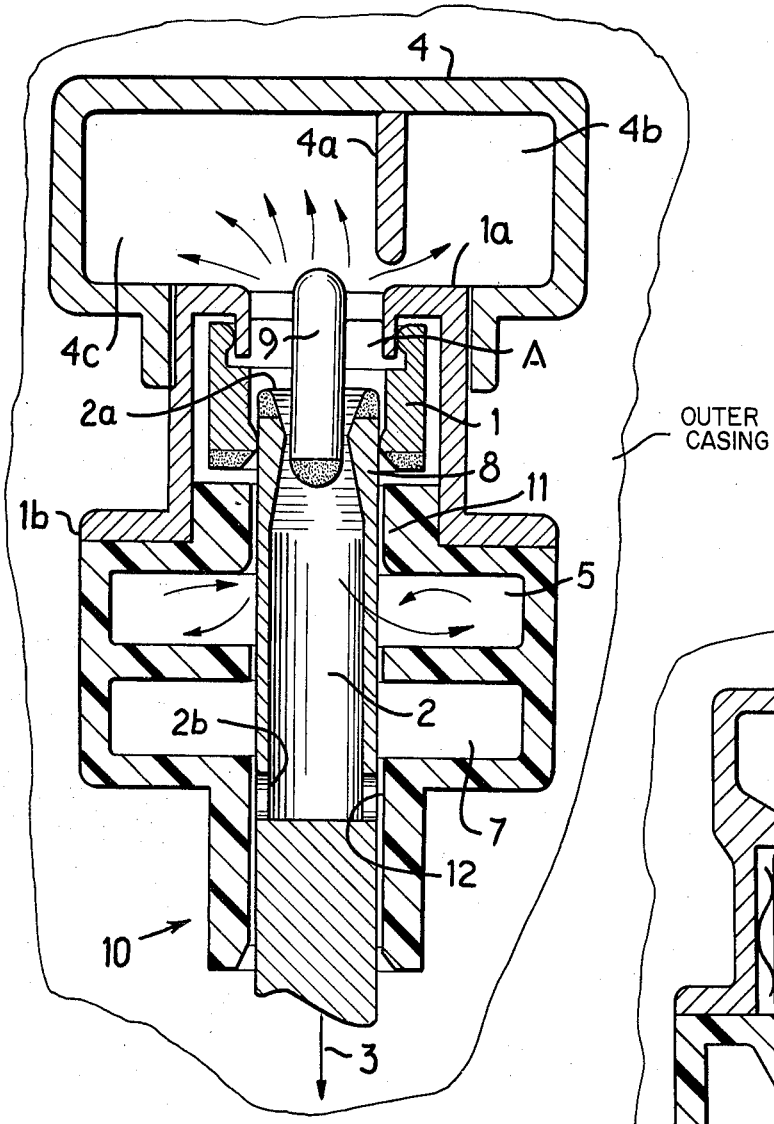
FIG. 2
FIG. 1
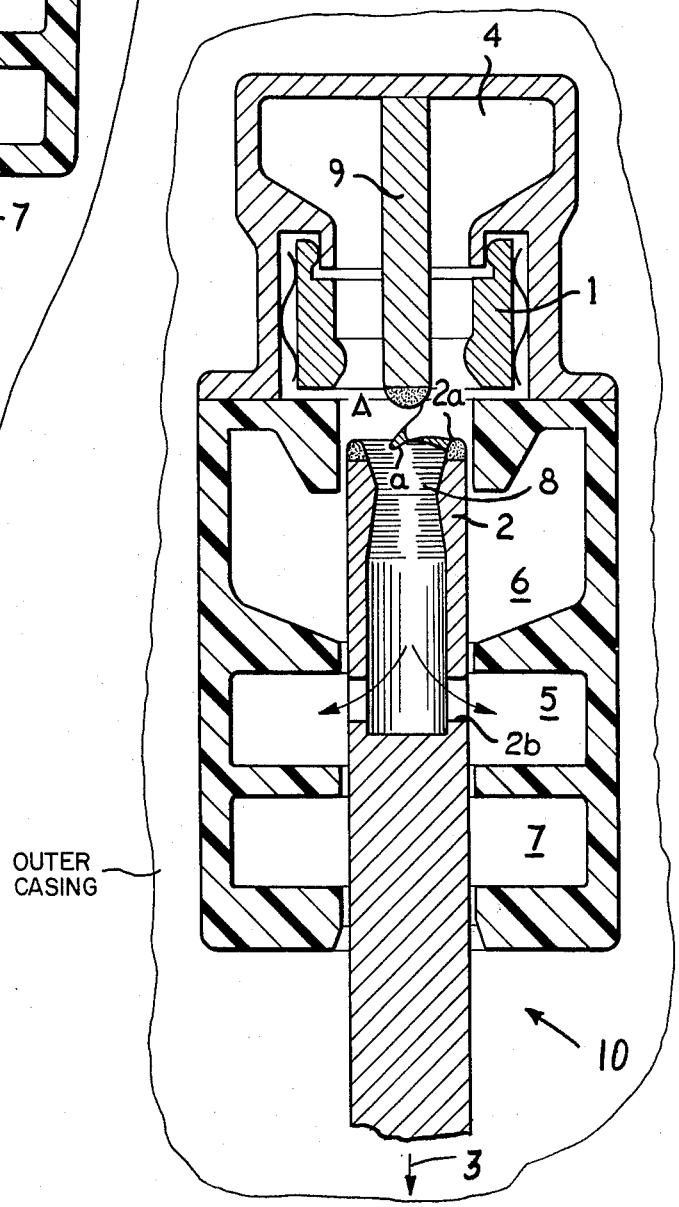

SELF-EXTINGUISHING TYPE CIRCUIT INTERRUPTER

BACKGROUND OF THE INVENTION

1. Field of the Invention

This invention relates to circuit interrupters wherein an arc extinguishing gas is puffed to an electric arc established between separated contacts to extinguish it.

2. Description of the Prior Art

It has been common practice in a circuit interrupter using a gas having a strong arc extinguishing capability such as $SF_6$ gas to generate a pressure difference in the gas by a suitable means and to puff high pressure gas to an electric arc to be extinguished, thereby effecting current interruption. There has been known two types of means for establishing the pressure difference.

One type of circuit interrupter known as the double pressure type comprises a gas filled at a predetermined pressure within a casing in which $SF_6$ gas is also filled and a separate pressure generating apparatus for generating a high pressure thereby obtaining the necessary pressure difference for generating a flow of gas for arc extinction. Upon interruption, a valve between the high pressure gas and the low pressure gas is opened in response to the contact opening operation to allow the high pressure gas to flow toward the arc, thereby blowing out the electric arc. With this type of circuit interrupter, the pressure generating apparatus for generating high pressure and maintaining it and the two pressure systems for high and low pressure gases are separately constructed, so that the overall structure of the interrupter is extremely complicated and large, rendering it uneconomical. Besides, it is disadvantageous in that it is less practical from the point of maintenance in always maintaining the high pressure gas.

The second type of circuit interrupter is known as a single pressure puffer-type wherein a puffer device disposed within a gas of a few atmospheres pressure filled in a sealed casing is operated in response to the interrupting operation to generate a high pressure gas, which gas is then puffed to the electric arc to extinguish it. This type of circuit interrupter utilizes compressed gas of a pressure lower than that used in the double pressure type, so that designing a practical casing structure is easier. However, the circuit interrupter requires a mechanical pressure generating device such as a puffer device operable in response to the interrupting operation. The puffer device requires a stronger driving force for a higher input electrical power and a higher interrupting current, inevitably requires the provision of a powerful operating mechanism in a large capacity circuit interrupter. It is also proposed to assist the large operating mechanism with an electromagnetically driven puffer device, but this operating mechanism is also disadvantageous in that it is large-sized, complicated in structure, not economical and not practical.

SUMMARY OF THE INVENTION

Accordingly, the chief object of the present invention is to provide a circuit interrupter having a good arc extinguishing capability with a simple structure.

With the above object in view, the present invention resides in a circuit interrupter comprising a pair of separable contacts disposed within a casing in which an arc extinguishing gas is filled and arranged so that the energy of an electric arc established between the separated contacts is utilized to increase the pressure of the arc extinguishing gas, whereby the high pressure gas thus generated is introduced into a pressure chamber to be temporarily stored therein. When the arc current decreases to zero, the high pressure gas within the pressure chamber is puffed to the arc to extinguish it. The circuit interrupter comprises a plurality of pressure chambers which are axially disposed or disposed in the direction of the movement of the movable contact. Each pressure chamber communicates with the arcing chamber in succession in accordance with the distance of movement of the movable contact, thereby effecting a multi-stage arc extinction.

BRIEF DESCRIPTION OF THE DRAWING

The present invention will become more readily apparent from the following description of the preferred embodiment of the present invention taken in conjunction with the accompanying drawings, in which:

FIG. 1 is a schematic sectional view illustrating the main portion of the circuit interrupter constructed in accordance with the present invention; and FIG. 2 is a schematic sectional view illustrating the main portion of another circuit interrupter embodying the present invention.

DESCRIPTION OF THE PREFERRED EMBODIMENTS

Referring now to the drawings and in particular to FIG. 1 wherein a circuit interrupter of the present invention is shown in the position immediately after the contact opening operation. The circuit interrupter comprises a stationary contact 1 and a movable contact 2 capable of contacting and separating from the stationary contact according to an unillustrated well-known operating mechanism. The contacts 1 and 2 are disposed within a casing of which the interior space 10 is filled with an arc extinguishing gas such as $SF_6$ gas. When the movable contact 2 is driven by the operating mechanism from the ON position in the direction shown by the arrow 3 into the illustrated OFF position in which the contacts 1 and 2 are separated from one another, an electric arc a is established in an arcing chamber A, and the pressure within a first pressure chamber 4 rapidly increases at a high propagation speed due to the thermal dissociating and expanding functions of the electric arc a.

The movable contact 2 includes a hollow portion 8 having a first opening 2*a* and a second opening 2*b*. Immediately after the contact opening, the first opening 2*a* opens to the pressure chamber 4 and the second opening 2*b* opens to the second pressure chamber 5, thereby communicating the first and the second pressure chambers 4 and 5 through the hollow portion of the movable contact 2. Therefore, immediately after contact opening, as the pressure in the first pressure chamber 4 increases, the pressure in the second pressure chamber 5 is also increased along the pressure transmission path through the first opening 2*a* and the second opening 2*b* of the movable contact 2. The temperature of the high pressure gas within the pressure chambers 4 and 5 propagates by convection and diffusion resulting in a slow propagation speed. Therefore the temperature in the pressure chambers 4 and 5 is elevated only to a limited extent. Therefore, when the movable contact moves further downward to communicate the first pressure chamber 4 with an auxiliary pressure chamber 6, the high pressure gas in the pressure chamber 4 flows into the auxiliary pressure chamber 6, where a low pressure, low temperature gas is contained, through the arcing chamber A as the current decreases to zero, and the arced gas is cooled and diffused to extinguish the arc a. The first stage arc extinction is thus effected. The auxiliary pressure chamber 6 has a volume large enough to maintain the flow of the high pressure gas from the first pressure chamber 4 into the auxiliary pressure chamber 6 for a predetermined period of time necessary for extinction of the arc a.

The above mentioned second pressure chamber 5 and the other second pressure chamber 7 disposed adjacently in the direction of the movement of the movable contact 2 are necessary under circumstances where the circuit conditions are severe like when the increase rate of the transient recovery-voltage is high. The inner high pressure gas is cooled and deionized with the lapse of the pressure-raising time during which the arc a increases the pressure of gas before the hollow portion 8 of the movable contact 2 communicates with the interior space 10 of the casing through the second opening 2*b*. Under these circumstances, when the opening 2*a* first opens to the pressure chamber 5 a high pressure gas which is approximately at the same pressure as the deionized new gas within the pressure chamber 5 acts upon the arc a and is released to the interior space 10 of the casing through the openings 2*a* and 2*b* as the current decreases to zero. In other words, the hollow portion 8 having the openings 2*a* and 2*b* constitutes a flow path for releasing the high pressure gas, and the pressure chambers 4, 5 and 6 containing the high pressure gas constitute a high pressure gas supply source for the flow path or the hollow portion 8. This supply source effects the second stage arc extinction.

A similar effect is obtained when the opening 2*a* further shifts to open to the other second pressure chamber 7, and even under the circumstances where the arcing time is long, the necessary arc extinguishing capability is maintained for the necessary period of time. The third stage arc extinction is thus effected. The second pressure chambers 5 and 7 may have additional similar chambers if desired, and axially arranged additional openings similar to the opening 2*b* may advantageously be provided.

When the unillustrated operating mechanism is driven by a trip command to move the movable contact 2 downward to cover a predetermined wiping distance, the contacts 1 and 2 are separated from each other, to establish an electric arc a within the arcing chamber A. The arc a is then transferred to the position between the arcing contact 9 and the movable contact 2 as seen from FIG. 1. This arc a in the arcing chamber A increases the pressure in the pressure chambers 4 and 5 to the value necessary for interruption until the opening 2*a* opens into the auxiliary pressure chamber 6. Then, the opening 2*a* opens to the auxiliary pressure chamber 6 to communicate the pressure chamber 4 to the auxiliary pressure chamber 6. The high pressure arc extinguishing gas in the pressure chamber 4 is released into the auxiliary pressure chamber 6 as the current decreases to zero to extinguish the arc.

Under severe circuit conditions where the electric arc can be extended to a longer length, the pressure in the pressure chamber 7 and the auxiliary pressure chamber 6 may be increased by the further downward movement of the movable contact 2. Since the pressure in the pressure chamber 7 tends to increase with the increase of the arc length, the pressure in the pressure chamber 7 is at a higher value than that in the pressure chamber 5 and is ready to be released through the opening 2*a* into the interior space 10 of the casing. Then, the opening 2*b* opens into the interior space 10 of the casing to release the high pressure in the pressure chambers 4 and 5 as the current decreases to zero, and when the pressure chambers 5 and 7 successively open into the arcing chamber A, the low temperature, high pressure arc extinguishing fluid clamps the electric arc a into the hollow portion 8 ensuring that the arc will be quickly extinguished at the zero current point. Arrows in the figure indicate the flow directions of the arc extinguishing gas.

FIG. 2 illustrates another embodiment of the present invention. The pressure chamber 4 is secured to a contact flange 1*a* above the stationary contact 1 and has a predetermined inner volume substantially closed. The pressure chamber 4 may be advantageously formed of a metallic material since the high temperature, high pressure gas flows therein upon interruption. The use of metallic material is advantageous in pressure resistant design and in cooling the high temperature gas. The pressure chamber 4 is divided into two chambers 4*b* and 4*c* by a partition wall 4*a* to asymmetrically divide the upflowing gas flow. The two chambers 4*b* and 4*c* have different pressure-raising characteristics and pressure-dropping characteristics, thereby preventing generation of excess pressure within the pressure chamber 4 and providing a time delay in abrupt gas release within a short period of time upon the interruption operation. The above measure is particularly effective in severe circuit conditions in which the transient recovery-voltage is high. When the gases in the two chambers 4*b* and 4*c* flow into the opening 2*a* formed in the tip portion of the movable contact 2, they are mixed at the upstream side of the opening 2*a*, thereby advantageously promoting neutralization of the ions in the gas. The arcing contact 9 is supported from the contact flange 1*a* and is arranged to close the opening 2*a* in the contact closed state and to facilitate the transfer of the electric arc upon the contact opening operation. The contact flange 1*a* includes a lower flange 1*b*, to which two pressure chambers 5 and 7 formed of a suitable insulating material such as Teflon (Trade Mark) and having a predetermined inner volume are secured. The upper and lower ends of the pressure chambers 5 and 7 have straight cylindrical portions 11 and 12, respectively, of suitable lengths. The lower cylindrical portion 12 closes the opening 2*b* until the pressure in the pressure chamber 4 increases to a value suitable for interruption at the initial stage of interruption, and the upper cylindrical portion 11 suppresses the flow of the high pressure gas from the pressure chamber 4 into the pressure chamber 5 during the period substantially corresponding to the closure of the opening 2*b*. This is for the purpose of preventing enlarging of the gas expansion space as this increases the time until the necessary pressure is reduced during the period in which pressure increase at the beginning of the contact opening operation is difficult. This trend is especially strong with a small current. Therefore the circuit interrupter illustrated in FIG. 2 is suitable for a small current interruption.

When the unillustrated operating mechanism is driven to move the movable contact 2 downward to cover a predetermined wiping distance and to separate from the stationary contact 1, an electric arc is established between the movable contact 2 and the stationary contact 1. The established arc transfers between the movable contact 2 and the arcing contact 9. The arc increases the pressure in the pressure chamber 4 to a value necessary for interruption until the opening 2*a* at the tip of the movable contact 2 passes beyond the cylindrical portion 11 and the vent opening 2*b* opens to the interior space 10 of the casing. When the movable contact 2 moves further downward to open the vent opening 2*b* to the interior space 10 of the case and the first zero value of the current approaches, the input electric power into the arc decreases as the arc current reaches zero, accompanied by a rapid decrease in arc pressure and temperature, whereby the high pressure gas within the pressure chamber 4 is released into the interior space 10 of the casing through the arcing chamber A, the opening 2*a*, the hollow portion 8 and the vent opening 2*b* to extinguish the arc. Thus the first stage arc extinction is effected. If the arc current is in the phase in which the arc current does not become zero immediately when the vent opening 2*b* opens to the interior space 10 of the casing, since the opening 2*a* is substantially closed by the arc, the high pressure gas in the pressure chamber 4 is allowed only in part to flow out into the space 10 of the casing and remains therein until the arc current approaches the zero value. During this "waiting" period for the zero arc current, the pressure chamber 4 is caused to communicate with the pressure chambers 5 and 7, so that the pressure chambers 5 and 7 which have been maintained at a low pressure suppress excessive pressure-rise in the pressure chamber 4, and at the same time build up an appropriate pressure in the chambers 5 and 7. When the arc current decreases to zero, the high pressure gas within the pressure chambers 5 and 7 is released therefrom in a ring-like shape to encircle the electric arc to clamp it within the opening 2*a* or the hollow portion 8 so that a rapid arc extinction can be effected. The second stage arc extinction is thus effected.

What is claimed is:

1. A circuit interrupter, comprising: a casing for containing an arc extinguishing gas in use; a pair of separable electrical contact elements disposed within said casing, said contact elements having a contacting position wherein said contact elements are in physical contact, and at least one of said contact elements being movable to separate said contact elements and establish an electric arc in use between said separable contact elements; arc containing means comprising a chamber with said contact elements disposed therein for containing an electric arc established in use upon separation of said contact elements; a first pressure chamber opening into said arc containing chamber for storing arc extinguishing gas at a raised pressure raised by the energy of the arc established between the separated contact elements and for puffing the arc extinguishing gas into the arc containing chamber at the raised pressure to extinguish the arc when the arc current decreases sufficiently close to zero; at least a second pressure chamber for storing arc extinguishing gas at a raised pressure and having an opening which opens into said arc containing chamber for puffing the arc extinguishing gas at the raised pressure to extinguish the arc when the arc current decreases sufficiently close to zero; and gas flow control means comprised of said movable contact element for closing said first and second pressure chambers when said contact elements are in the contacting position, for opening said first pressure chamber when said contact elements separate and an arc is formed therebetween to increase the gas pressure within said first chamber, for releasing the gas at a raised pressure from said first chamber through said arc containing chamber to effectuate a first blast of high pressure gas and extinguish the arc within said arc containing chamber as said contact elements further separate, and for releasing the gas at a raised pressure from said second chamber through said arc containing chamber to effectuate a second blast of high pressure gas and extinguish any remaining arc within said arc containing chamber as said contact elements separate still further.

2. A circuit interrupter as claimed in claim 1, wherein said first and second pressure chambers are in communication with each other through said arc containing chamber, and wherein said gas flow control means is effective to permit the flow of high pressure gas from said first pressure chamber into said second pressure chamber for charging said second pressure chamber with high pressure gas before said first pressure chamber is opened to release the high pressure gas and extinguish the arc.

3. A circuit interrupter as claimed in claim 1, wherein said first pressure chamber comprises an internal partition asymmetrically disposed within said first pressure chamber for dividing said first pressure chamber into two communicating chamber portions having different pressure-raising and pressure-decreasing characteristics.

4. A circuit interrupter as claimed in claim 1, wherein: said arc containing chamber is elongated and cylindrical; said first pressure chamber opens into one end of said arc containing chamber; said second pressure chamber opens into an opposite end of said arc containing chamber; and said movable contact element comprising said gas flow control means is an elongated hollow member extending through said arc containing chamber and dimensioned to close said arc containing chamber, said movable contact element having an open end cooperative with the other of said contact elements for closing said first pressure chamber when said contact elements are in the closed position and for providing a gas flow path through said movable contact element when said contact elements are separated, and said movable contact element having an outlet opening positioned for venting into said casing gas flowing through said movable contact element after said contact elements have separated a predetermined distance.

5. A circuit interrupter as claimed in claim 4, wherein the outlet opening in said movable contact element is positioned to vent gas flowing through said movable contact element to charge said second pressure chamber with high pressure gas when said contact elements have separated a certain distance, and for subsequently venting gas flowing through said movable contact element into said casing when said contact elements have separated the predetermined distance.

* * * * *